US005802735A

United States Patent [19]

Schoonhoven

[11] Patent Number: 5,802,735

[45] Date of Patent: Sep. 8, 1998

[54] DENTAL MODEL DRYER

[76] Inventor: John Schoonhoven, 280 Grove Ave., Des Plaines, Ill. 60016

[21] Appl. No.: 738,029

[22] Filed: Oct. 24, 1996

[51] Int. Cl.[6] ..... F26B 17/12

[52] U.S. Cl. ..... 34/174; 34/175; 34/194; 34/196; 433/77; 433/79

[58] Field of Search ..... 34/60, 61, 103, 34/104, 106, 107, 165, 174, 175, 192, 194, 196, 237, 238, 233; 433/77, 79; 211/126

[56] References Cited

U.S. PATENT DOCUMENTS

| | | | |
|---|---|---|---|
| 1,001,660 | 8/1911 | Macklind | 34/175 |
| 1,409,915 | 3/1922 | Barducci | 34/196 |
| 2,911,732 | 11/1959 | Webb | 34/196 |
| 3,936,937 | 2/1976 | Gordon | 433/77 |
| 4,190,965 | 3/1980 | Erickson | 34/196 |
| 4,236,063 | 11/1980 | Glucksman | 34/196 X |
| 4,445,859 | 5/1984 | Hoffmeister et al. | 433/77 X |

*Primary Examiner*—Henry A.. Bennett
*Assistant Examiner*—Steve Gravini
*Attorney, Agent, or Firm*—Seyfarth, Shaw, Fairweather & Geraldson

[57] ABSTRACT

A dryer for drying dental models includes a solid base member, a top member, a variable plurality of modular drying units, each of which includes a frame and a slidable, foraminous tray, an air blower and an articulated support arm. In use, the modular drying units are positioned in an over-and-under stacked relation, such that the slidable trays therein form a column of trays. Each slidable tray contains a central aperture and a duct extending upward from the perimeter of the central aperture. The aperture and duct in the center of each tray collectively form a channel running through the center of the column of trays. The base member is fixedly connected to the articulated support arm, which supports the dryer. The top member, which is positioned on top of the uppermost modular drying unit, includes a central aperture with an inlet tube inserted therein and exhaust vents around the perimeter of its top surface for the release of air. The air blower is inserted into the inlet tube in the central aperture of the top member. The air blower propels heated air downward through the channel in the center of the column of trays towards the base member. When the air reaches the solid base member, it is deflected outward and upward through the foraminous trays, passes over and quickly dries the dental models and then exits through the exhaust vents.

22 Claims, 2 Drawing Sheets

DENTAL MODEL DRYER

BACKGROUND OF THE INVENTION

This invention relates generally to a device for drying dental models, and specifically to such a device which dries dental models more rapidly than other methods generally used in the dental industry.

Dentists, dental technicians, orthodontists and other dental professionals in the dental industry have been making models of their patients' teeth for well over 100 years. Dental models allow dental professionals to more effectively care for their patients' teeth. For example, dental technicians utilize dental models to construct prostheses for their patients, such as crowns, bridges and dentures. Moreover, orthodontists use orthodontic models to monitor the movement of their patients' teeth into the desired positions.

One problem previously encountered in the dental industry was the lengthy period of time required to dry dental models and/or parts thereof. In the past, after creating a model, or partial model, of a patient's teeth, some dental professionals would place the model, or partial model, in a dry area, for several hours, to ensure that it had dried sufficiently to permit further assembly, construction, refinements, examination and/or storage. Other dental professionals would not allow sufficient time for the model, or partial model, to completely dry before further assembly, construction and/or refinements, which would result in an inaccurate, substandard model of a patient's teeth.

Another problem previously encountered in the dental industry was the large amount of space required to dry multiple dental models. If a dental professional made models of several patients' teeth within a short period of time, he would need to set aside a large amount of space in his office solely for the purpose of drying the models. Since the models required several hours to dry completely, this often meant that a great deal of precious working space was devoted solely for this purpose. Even when the models were dry and moved to a different area for further assembly, refinement or storage, the dental professional was forced to keep the area clear for the next batch of dental models to be dried.

Although dental model dryers are not disclosed in the prior art, machines for drying food are well known in the prior art. U.S. Pat. Nos. 4,190,965, 4,236,063, and PCT International Publication No. WO 94/08186, disclose food dehydrators comprising a plurality of stackable, foraminous trays and electric means of heating and propelling air over the items to be dried.

In addition, U.S. Pat. No. 3,807,057 discloses an apparatus for use in the uniform proofmg of English muffin doughballs, which includes a plurality of slidable trays, each comprising four circular, foraminous cavities equally spaced along the length of the tray.

SUMMARY OF THE INVENTION

It is, therefore, an important object of the invention to provide a device capable of drying multiple dental models in a short period of time.

It is another object of the invention to provide a device capable of drying multiple dental models which requires only a small amount of space to function effectively, and can be easily stowed away when not in use.

In connection with the foregoing object, another object of the invention is the provision of a model drying device which has an easily variable capacity.

In summary, there is provided a dental model dryer, which includes a variable plurality of stackable, modular drying units, a base member, a top member, an air blower and an articulated support arm. Each modular drying unit includes a frame and a foraminous tray slidable on the frame having an aperture in its center. Each modular drying unit includes a step around the lower perimeter of its frame which allows it to be positioned in an over-andunder stacked relation with other like modular drying units to form a column of trays with the central apertures collectively forming a channel running through the center of the column of trays. Unlike the slidable trays, the base member is solid, not foraminous. The air blower can comprise any electrical means for propelling heated air, usually an electric hair dryer. The top member includes a plurality of exhaust vents and an extension tube, which is attached to and inserted down through the top member through a round aperture in the center of the top member. The extension tube allows for insertion of a drying means into the model dryer and directs heated air downward through the channel running through the center of the column of trays.

The entire device is supported by an articulated support arm, which allows the device to be easily accessed and moved into any position in the desired working space, and compactly stowed away when not in use.

Further objects, features and advantages of the invention will become evident from a consideration of the following detailed description when taken in conjunction with the accompanying drawings and claims.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
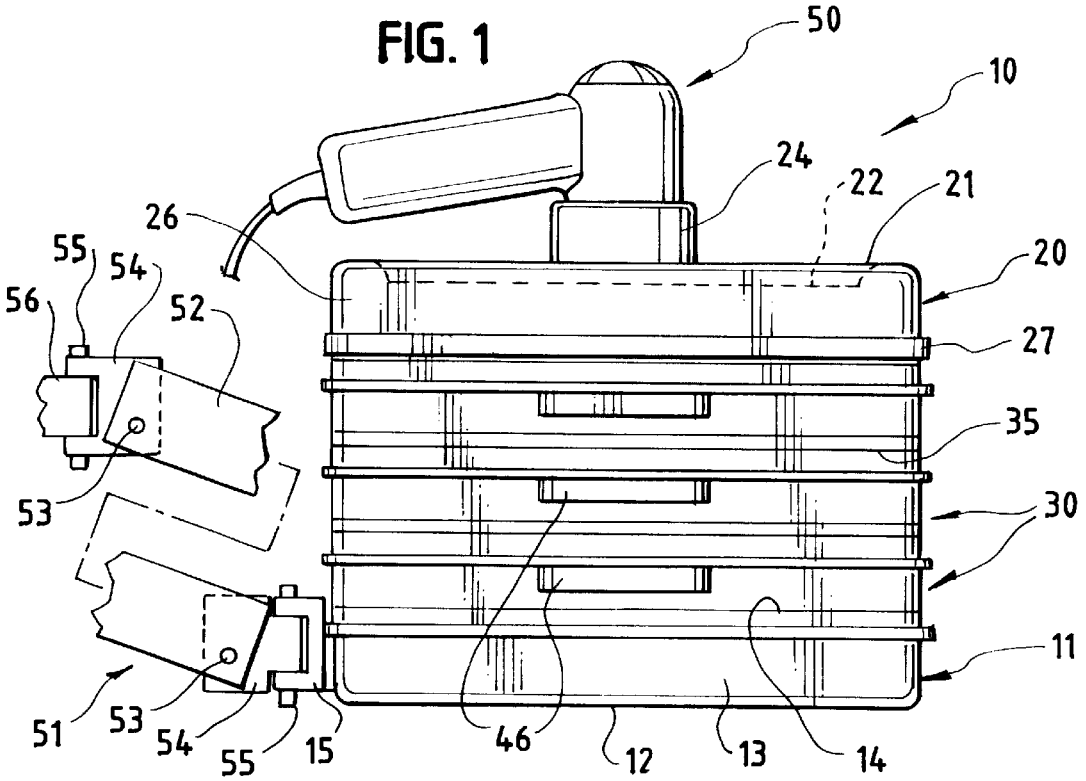
FIG. 1 is a front elevational view of a preferred embodiment of the model dryer mounted on a fully extended articulated support arm, a portion of which is broken away.

Turning now to FIGS. 1–5, there is depicted a preferred embodiment of the invention. A dental model dryer 10 includes a base member 11, a top member 20, a variable plurality of modular drying units 30, each of which includes a slidable, foraminous tray 40, an air blower 50 and an articulated support arm 51.

Figure 2:
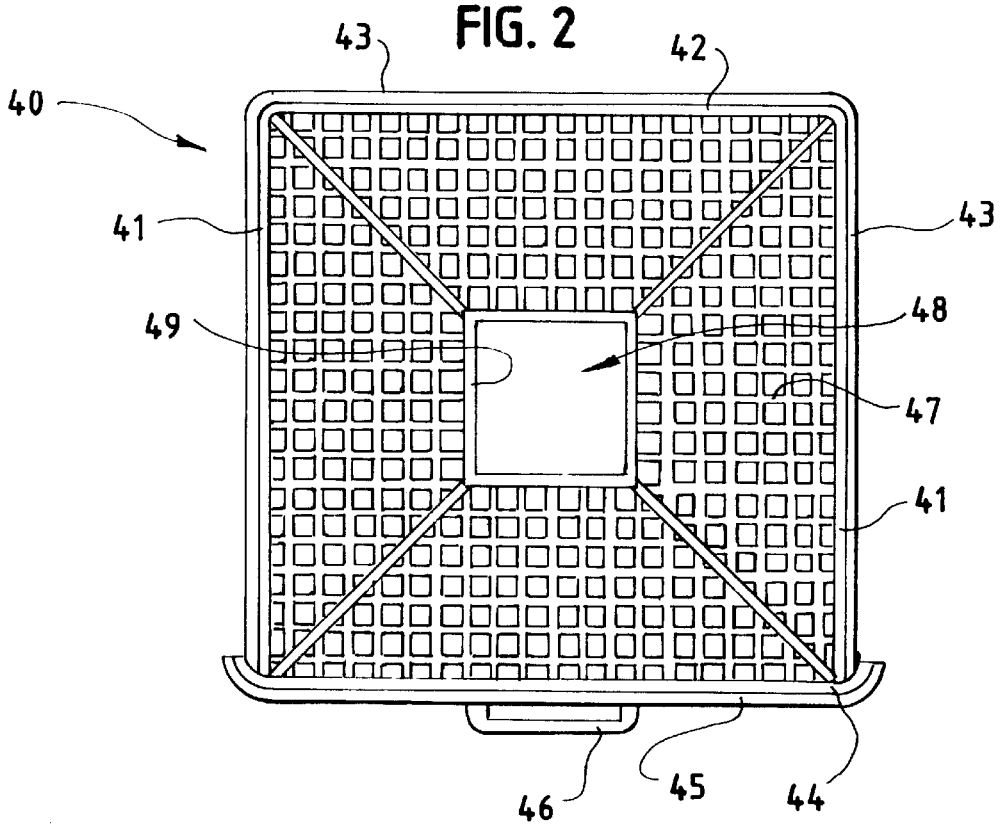
FIG. 2 is a top plan view of a slidable tray of the dryer of FIG. 1.

Each modular drying unit 30 includes a frame 31 and a tray 40 slidable with respect to the frame 31, and is made of a rigid material, preferably a suitable plastic, which will not melt or deform at temperatures less than 200 degrees Fahrenheit. As best shown in FIG. 2, the frame 31 of each modular drying unit 30 has side walls 32, a rear wall 33, a front wall 34, an opening 35 below front wall 34 and open upper and lower ends. The frame 31 includes an outer flange 36, which assists in the lifting of the frame 31, and a stepped portion 37 and an outer shoulder 39 located around the lower perimeter of the side walls 32 and the rear wall 33 to facilitate the stacking of a plurality of modular drying units 30 in an over-and-under stacked relation.

Each tray 40 has side walls 41, a rear wall 42, a front wall 43 and a foraminous floor 47. The tray 40 includes a flange 45 on its front wall 43, which cooperates with the associated frame flange 36 to aid in lifting the modular drying unit 30. The tray 40 is slidable with respect to the associated frame 31. The tray 40 includes a guide flange 43 at the lower ends of the side walls 41 and the rear wall 42. The frame includes an inner flange 36*a* and an inner shoulder 39*a* which extend along the side walls 32 and the rear wall 33 and cooperate to form a channel 38. The guide flange 43 slides horizontally in the channel 38. A handle 46 on the tray 40 facilitates sliding it out of or into the frame 31, as may be desired.

Figure 5:
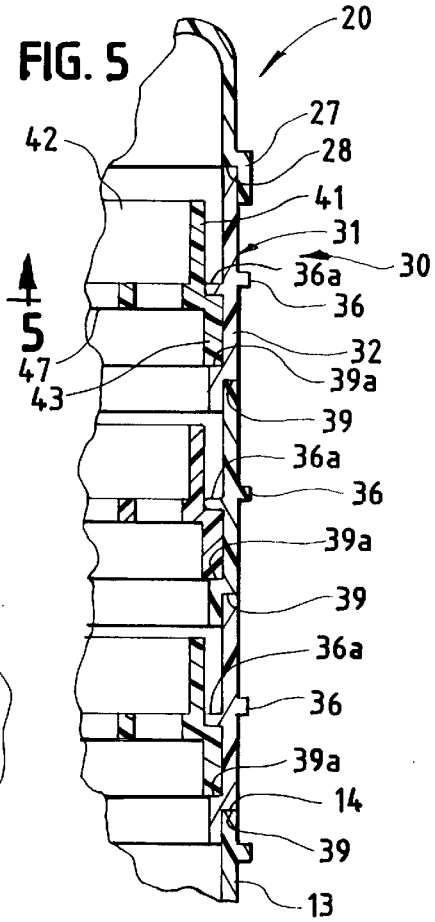
FIG. 5 is an enlarged, fragmentary sectional view, taken along Line 5—5 in FIG. 4, showing the profiles of the steps around the lower perimeters of the frames of the modular drying units.

The tray floor 47 of the tray 40 includes a central aperture 48 and a duct 49, which extends upward from the perimeter of the central aperture 48. As shown in FIG. 2, the aperture 48 is square, but it could have any geometric shape, including, but not limited to circular, triangular or rectangular. As best illustrated in FIG. 5, when a plurality of modular drying units 30 are positioned in an over-and-under stacked relation, as described below, central apertures 48 and ducts 49 in the center of each tray 40 form a channel running through the center of the column of trays therein in their closed positions.

The top member 20 is also made of a rigid material, preferably a suitable plastic, which will not melt or deform at temperatures less than 200 degrees Fahrenheit. The top member 20 includes a top wall 21 with a recessed central portion 22, depending side walls 26, and a skirt flange 27, which defmes an inner shoulder 28. The top wall 21 also includes a circular aperture 23 into which is inserted an extension tube 24. The extension tube 24 allows for insertion of an air blower 50, which propels heated air into the dryer 10. The extension tube 24 directs the heated air downward through the channel running through the center of the column of trays formed by the central apertures 48 and ducts 49 in the center of each tray 40 in their closed positions. The top member 20 also includes a plurality of exhaust vent holes 25 positioned around the perimeter of the top wall 21 to permit the escape of excess air.

The base member 11 is also made of a rigid material, preferably a suitable plastic, which will not melt or deform at temperatures less than 200 degrees Fahrenheit. Unlike the slidable trays 40, the base member 11 is imperforate. The base member 11 includes a bottom wall 12 and upstanding side walls 13 terminating at a continuous upper edge 14.

The base member 11 is fixedly connected to a coupling bracket 15, which is hingedly connected to end section 54 at pivot joint 55. End section 54 is hingedly connected to articulated support arm 51 at pivot joint 53. At the other end of articulated support arm 51, extension section 52 is hingedly connected to end section 54 at pivot joint 53. Similarly, end section 54 is hingedly connected to mounting bracket 56 at pivot joint 55. Articulated support arm 51, end sections 54, pivot joints 53, 55 and mounting bracket 56 support the dental model dryer 10 and allow it to be easily accessed and moved into any position in the desired working space and quickly moved away for stowage.

Figure 3:
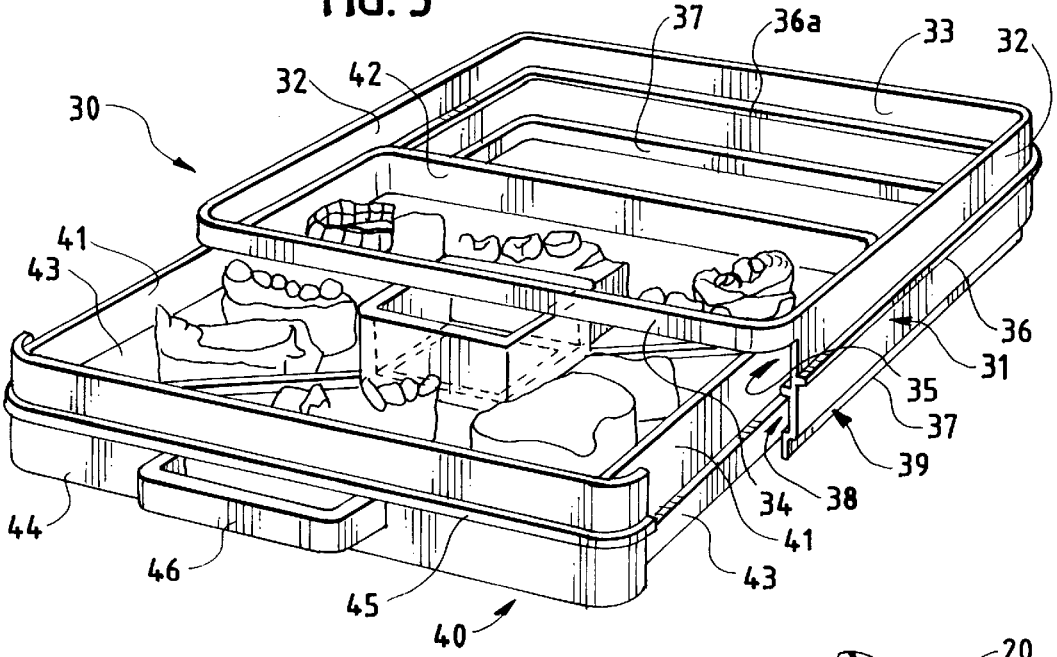
FIG. 3 is an enlarged front perspective view of one of the modular drying units of the dryer of FIG. 1, with the slidable tray partially opened to reveal the contents therein.

In a preferred embodiment, a plurality of modular drying units 30 are positioned in an over-and-under stacked relation to form a column of drying units 30, as best shown in FIG. 1. The number of modular drying units 30 used may be varied depending on the number of dental models to be dried. As best shown in FIG. 3, the frame 31 of each modular drying unit 30 includes a stepped portion 37 and an outer shoulder 39 located around the lower perimeter of the side walls 32 and the rear wall 33 such that, when multiple modular drying units 30 are positioned in an over-an-under stacked relation as shown in FIG. 1, the stepped portion 37 of an upper modular drying unit 30 fits within, and the outer shoulder 39 rests on the top of the top edges of the side walls 32 and rear wall 33 of the frame 31 of the underlying modular drying unit 30.

As best shown in FIG. 1, the lowermost modular drying unit 30 is positioned above the base member 11 such that the stepped portion 37 fits within the base member 11 and the outer shoulder 39 rests on the continuous upper edge 14. As shown in FIG. 1, the top member 20 is positioned on top of the uppermost modular drying unit such that the inner shoulder 28 of the skirt flange 27 rests on the top edges of side walls 32 and rear wall 33. The air blower 50 is inserted into and through the extension tube 24, which is connected to and extends into the top member 20 through the round aperture 23 in the center of the recessed central portion 22 of the top member 20. The extension tube 24 directs the heated air into the dryer 10.

Figure 4:
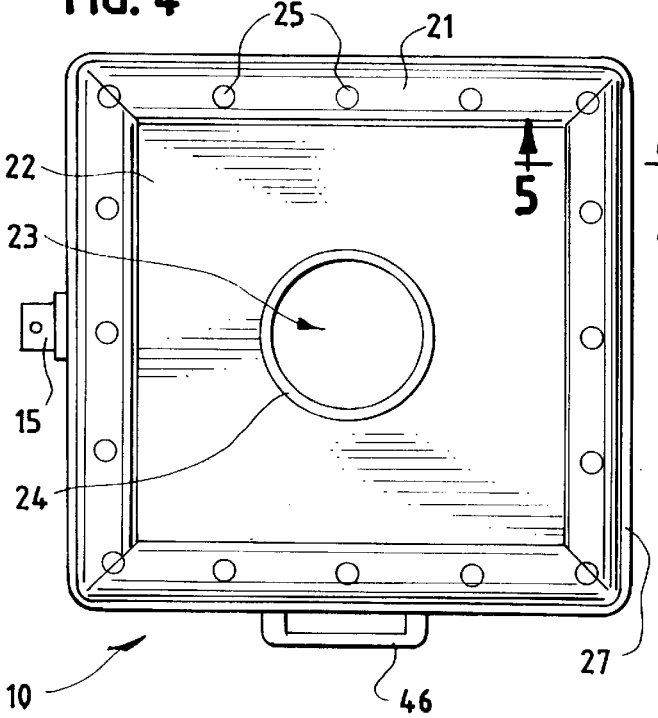
FIG. 4 is a top plan view of the dryer of FIG. 1 with the air blower removed.

As best shown in FIG. 3, the slidable trays 40 within each modular drying unit 30 are opened by pulling the handle 46 of the tray 40 and sliding the tray 40 outward. Once the dental models are placed into the trays 40 for drying, the trays 40 are closed, and the air blower 50 is activated. The air blower 50 propels dry, heated air through the channel in the center of the column of trays 40 collectively formed by the ducts 49 and square apertures 48 in centers of each of the trays 40 in their closed positions. When the heated air reaches the solid base member 11, it is deflected outward and upward. As best illustrated in FIG. 2, the floors 47 of the trays 40 are foraminous, which allows the heated air to pass up through the floors 47 of the trays 40 and over the dental models positioned thereon, thus drying same. When the heated air has passed upward through the entire column of trays 40, it reaches the top member 20 and is expelled out of the dryer 10 through exhaust vents holes 25, which, as best shown in FIG. 4, are located around the perimeter of the top wall 21 of the top member 20.

In an alternate embodiment (not shown), the frame of the modular drying unit may have a fixed foraminous floor instead of a slidable tray.

The invention has been described above in an illustrative manner and it is to be understood that terminology which has been used is intended to be in the nature of description rather than of limitation. Obviously, many modifications and variations of the present invention are possible in light of the above teachings. It is therefore to be understood that within the scope of the claims, the invention may be practiced otherwise than as specifically described.

What is claimed is:

1. A dryer for drying dental models comprising:

a base member;

a model support section stacked on said base member and including at least one modular drying unit for supporting dental models therein;

said modular drying unit including a frame and a tray slidable with respect to the frame between open and closed positions; and a top member stacked on said model support section, said dryer having vent openings therein to accommodate air flow therethrough.

2. A dryer according to claim 1, wherein at least one of said base member and said top member has vent openings therein to permit entry and exit of air.

3. A dryer according to claim 1, wherein said tray is foraminous.

4. A dryer according to claim 3, wherein said tray includes a central aperture.

5. A dryer according to claim 4, wherein said tray includes a duct extending upward from the perimeter of said central aperture.

6. A dryer according to claim 5, wherein said top member includes a central inlet vent hole vertically aligned with said duct and peripheral outlet vent holes.

7. A dryer according to claim 6, wherein said top member includes a tube communicating with said central inlet vent hole.

8. A dryer according to claim 7, and further comprising an air blower insertable into said top member through said inlet vent tube.

9. A dryer according to claim 1, wherein said model support section includes a plurality of modular drying units, each including a frame and a slidable tray and positioned in an over-and-under stacked relation to form a column of said trays with said central apertures in said centers of said trays forming a channel down and through the center of said column of trays in their closed positions.

10. A dryer according to claim 9, wherein each of said frames includes a stepped portion and a shoulder around its lower perimeter to facilitate stacking of said plurality of modular drying units.

11. A dryer according to claim 10, wherein each said modular drying unit includes an outer flange around the perimeter of said modular drying unit to facilitate unstacking of said plurality of modular drying units.

12. A dryer according to claim 1, wherein said modular drying unit includes track structure to guide sliding movement of the associated tray.

13. A dryer according to claim 12, wherein said tray includes a handle for ease of slidability.

14. A dryer according to claim 1, wherein said base member is solid.

15. A dryer according to claim 1, wherein said base member is fixedly mounted to an articulated support arm.

16. A dryer according to claim 15, wherein said articulated support arm includes a plurality of hinges which allows said articulated support arm to be moved into any desired working position.

17. A modular drying unit for drying dental models comprising:

a frame including upstanding peripheral wall structure having open upper and lower ends;

track structure carried by said frame;

a tray having a foraminous model-supporting wall disposed substantially horizontally in use and slidable on said track structure between open and closed positions relative to said frame; and coupling structure on said frame to facilitate stacked coupling thereof to other like frames, said foraminous wall cooperating with said open ends of said wall structure to define a vertical air flow path throuah said drying unit.

18. A modular drying unit according to claim 17, wherein said tray includes a central aperture.

19. A modular drying unit according to claim 18, wherein said tray includes a duct extending upward from the perimeter of said central aperture.

20. A modular drying unit according to claim 17, and further comprising an outer flange around the perimeter of said modular drying unit to permit lifting of said modular drying unit.

21. A modular drying unit according to claim 17, wherein said tray includes a handle for ease of slidability.

22. A modular drying unit according to claim 17, wherein said coupling structure includes a stepped portion and a shoulder around the lower perimeter of said frame.

* * * * *